US011247856B2

(12) United States Patent
Bui

(10) Patent No.: US 11,247,856 B2
(45) Date of Patent: Feb. 15, 2022

(54) SHEET POSITIONING MEMBER, SHEET STORAGE DEVICE INCLUDING SHEET POSITIONING MEMBER, AND IMAGE PROCESSING APPARATUS INCLUDING SHEET STORAGE DEVICE

(71) Applicant: KYOCERA Document Solutions Inc., Osaka (JP)

(72) Inventor: Dang Long Bui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 171 days.

(21) Appl. No.: 16/696,930

(22) Filed: Nov. 26, 2019

(65) Prior Publication Data

US 2020/0165089 A1 May 28, 2020

(30) Foreign Application Priority Data

Nov. 28, 2018 (JP) ..... JP2018-222277

(51) Int. Cl.
*B65H 1/04* (2006.01)
*B65H 7/10* (2006.01)
*B65H 9/00* (2006.01)

(52) U.S. Cl.
CPC ..... *B65H 1/04* (2013.01); *B65H 7/10* (2013.01); *B65H 9/004* (2013.01); *B65H 2405/1144* (2013.01); *B65H 2405/12* (2013.01); *B65H 2511/12* (2013.01)

(58) Field of Classification Search
CPC ..... B65H 1/04; B65H 2405/114; B65H 2405/1144; B65H 2405/11425; B65H 2405/12; B65H 2511/12; B65H 2403/51; B65H 2403/511; B65H 2403/512; B65H 2403/513
See application file for complete search history.

(56) References Cited

U.S. PATENT DOCUMENTS

2003/0116907 A1* 6/2003 Pearce ..... B65H 1/266 271/145

FOREIGN PATENT DOCUMENTS

EP 1413533 A1 * 4/2004 ..... B65H 1/04
JP 09183522 A 7/1997

* cited by examiner

*Primary Examiner* — Prasad V Gokhale
(74) *Attorney, Agent, or Firm* — Alleman Hall Creasman & Tuttle LLP

(57) ABSTRACT

A sheet positioning member is provided on a sheet placing surface in such a way as to be movable in a predetermined first direction. The sheet positioning member includes a moving body, an abutting portion, an operation member, and a cam portion. The moving body moves in the first direction on the sheet placing surface. The abutting portion has an abutting surface that abuts on the side end portion when the sheet positioning member positions the sheet. The operation member is supported by the moving body so as to be pivotable around a support shaft that extends in the first direction, on a side of a back surface of the abutting portion. The cam portion displaces the abutting portion toward the side end portion by being pressed by the operation member in response to a pivoting operation of the operation member.

8 Claims, 14 Drawing Sheets

SHEET POSITIONING MEMBER, SHEET STORAGE DEVICE INCLUDING SHEET POSITIONING MEMBER, AND IMAGE PROCESSING APPARATUS INCLUDING SHEET STORAGE DEVICE

INCORPORATION BY REFERENCE

This application is based upon and claims the benefit of priority from the corresponding Japanese Patent Application No. 2018-222277 filed on Nov. 28, 2018, the entire contents of which are incorporated herein by reference.

BACKGROUND

The present disclosure relates to a mechanism that is provided on a sheet placing surface in such a way as to be movable in a predetermined first direction, and positions a sheet placed on the sheet placing surface by abutting on a side end portion of the sheet in the first direction.

There is known an image forming apparatus that includes a paper cassette for storing paper sheets (sheets) on which images are to be printed. The paper cassette stores a plurality of sheets. Conventionally, the paper cassette includes a positioning member (cursor) to prevent the plurality of stored sheets from being displaced from a predetermined position. The positioning member regulates a sheet stack set on an upper surface of a lift plate to the predetermined position in a width direction.

In addition, there is known a paper cassette (sheet cassette) including a positioning member (regulating member) that presses a side surface of stored sheets by an elastic force of a spring member.

SUMMARY

A sheet positioning member according to an aspect of the present disclosure is provided on a sheet placing surface in such a way as to be movable in a predetermined first direction, and positions a sheet placed on the sheet placing surface by abutting on a side end portion of the sheet at a side in the first direction. The sheet positioning member includes a moving body, an abutting portion, an operation member, and a cam portion. The moving body is configured to move in the first direction on the sheet placing surface. The abutting portion is supported by the moving body and has an abutting surface that abuts on the side end portion of the sheet when the sheet positioning member positions the sheet. The operation member is supported by the moving body so as to be pivotable around a support shaft that extends in the first direction, on a side of a back surface of the abutting portion, the back surface being opposite to the abutting surface. The cam portion is configured to displace the abutting portion toward the side end portion of the sheet by being pressed by the operation member in response to a pivoting operation of the operation member.

A sheet storage device according to another aspect of the present disclosure includes the sheet positioning member and a sheet storage portion that includes the sheet placing surface, the sheet storage portion configured to store the sheet stacked on the sheet placing surface.

An image processing apparatus according to a further aspect of the present disclosure includes the sheet storage device and an image processing portion configured to perform image processing on the sheet fed from the sheet storage device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure. It is noted that, for the sake of explanation, an up-down direction D1, a front-rear direction D2, and a left-right direction D3 are defined with respect to a state where an image forming apparatus 10 is usably installed (the state shown in FIG. 1).

Figure 1:
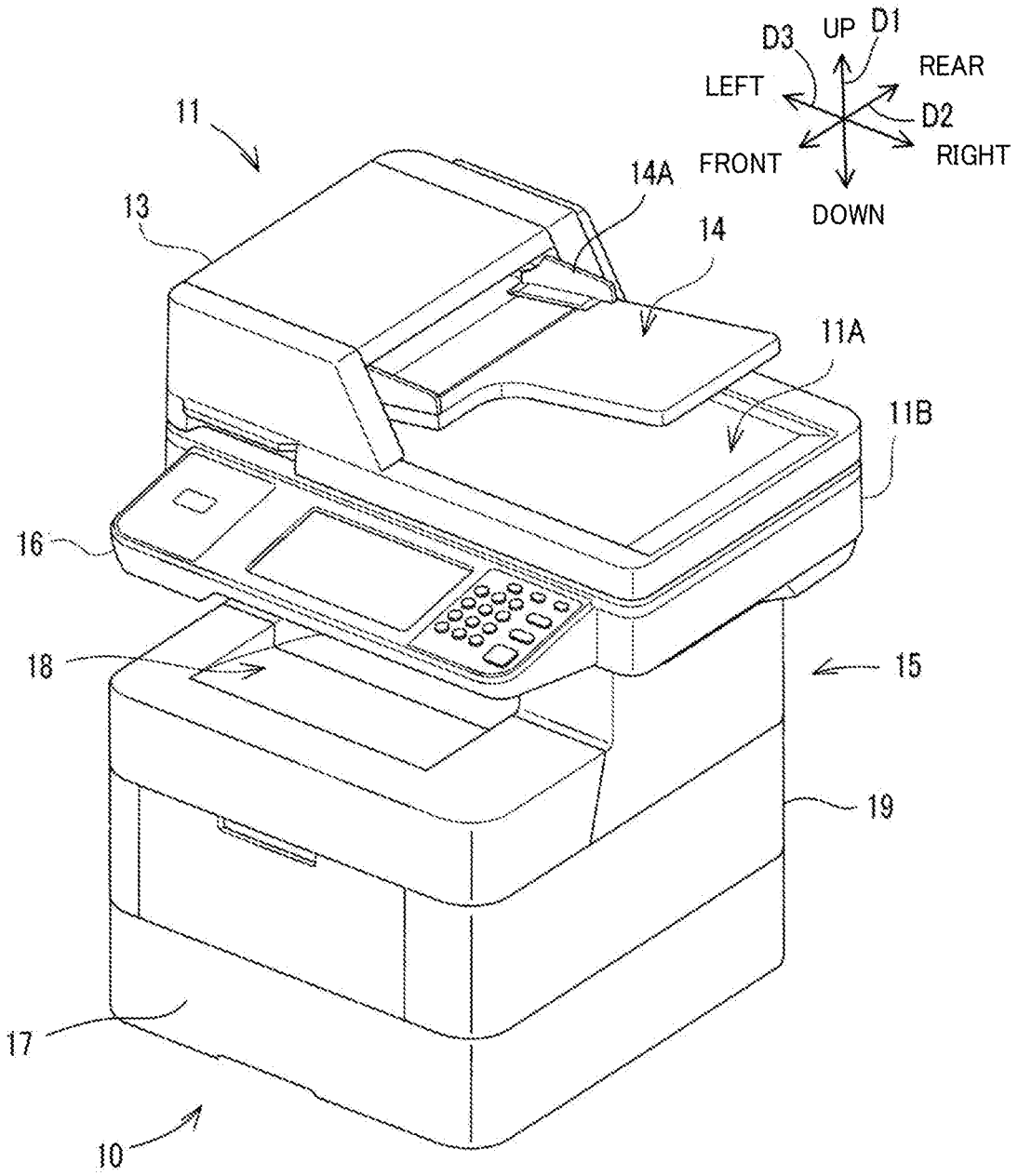
FIG. 1 is a perspective diagram showing a configuration of an image forming apparatus according to an embodiment of the present disclosure.

The following describes, with reference to FIG. 1, an image reading device 11 according to an embodiment of the present disclosure and the image forming apparatus 10 including the image reading device 11. It is noted that the image reading device 11 and the image forming apparatus 10 are each an example of an image processing apparatus of the present disclosure.

The image forming apparatus 10 is a multifunction peripheral having a plurality of functions such as a print function, a copy function, a scan function, and a facsimile function. FIG. 1 is a perspective diagram of the image forming apparatus 10 (an example of the image processing apparatus of the present disclosure) according to the embodiment of the present disclosure. As shown in FIG. 1, the image forming apparatus 10 includes the image reading device 11, an auto document feeder (ADF) 13, an image forming portion 15 (an example of an image processing portion of the present disclosure), an operation/display portion 16, a paper cassette 17 (an example of a sheet storage device of the present disclosure), a sheet feed mechanism (not shown), and a sheet discharge portion 18.

The present embodiment describes, as one example, the image forming apparatus 10 including the image reading device 11. However, the present disclosure is not limited to the configuration. For example, the present disclosure is applicable to an image processing apparatus such as: a printer (an image forming apparatus) that includes the paper cassette 17, and has only the print function; and a scanner (an image reading device) that includes a document sheet tray 14, and has only the scan function. It is noted that in this case, the paper cassette 17 and the document sheet tray 14 are each an example of the sheet storage device of the present disclosure.

The image forming portion 15 executes a color or monochrome image forming process (an example of image processing of the present disclosure) by an electrophotographic method based on image data read by the image reading device 11, or image data input from an information processing apparatus such as an external personal computer. The image forming portion 15 includes an image forming unit, an exposure device, an intermediate transfer belt, a secondary transfer roller, and a fixing device. The image forming unit includes a photoconductor drum, a charging device, a developing device, a primary transfer roller, and a cleaning device (all of these components are not shown). These components are disposed in a housing 19 that constitutes a frame or the like of the image forming portion 15.

The present embodiment describes, as one example, the image forming portion 15 adopting the electrophotographic method. However, the method of the image forming portion 15 is not limited to the electrophotographic method, but may be an inkjet recording method or any other recording or printing method.

The ADF 13 is provided in the image reading device 11. The image reading device 11 includes the document sheet tray 14. One or more document sheets (an example of a sheet of the present disclosure) that are the reading target, are placed on the document sheet tray 14. The ADF 13 picks up the document sheets one by one from the document sheet tray 14, and feeds them in succession to a predetermined reading position. Here, the image reading device 11 reads an image from a document sheet at the reading position, and a reading unit irradiates light to the reading position.

The document sheet tray 14 includes a cursor 14A for positioning the document sheets placed on the document sheet tray 14 to a predetermined position in the front-rear direction D2. The cursor 14A is provided on an upper surface (sheet placing surface) of the document sheet tray 14. The cursor 14A extends in a width direction (the left-right direction D3) of the document sheet tray 14 and is configured to move frontward from a rear end portion on the upper surface of the document sheet tray 14. The cursor 14A abuts on a rear end portion of a stack of document sheets placed on the document sheet tray 14, and position the stack of document sheets to the predetermined position.

The image reading device 11 is attached to an upper portion of the image forming apparatus 10. The image reading device 11 includes a reading unit, a contact member, a document sheet pressing 11A, and a housing 11B. The above-mentioned components are stored in the housing 11B of the image reading device 11. The image reading device 11 executes an image reading process (an example of the image processing of the present disclosure) of reading image data from a document sheet. For example, the image reading device 11 executes a process of reading an image from a document sheet that has been fed by the ADF 13 and is moving, and a process of reading an image from a document sheet placed still on the contact member.

The following describes the paper cassette 17 in detail.

Figure 2:
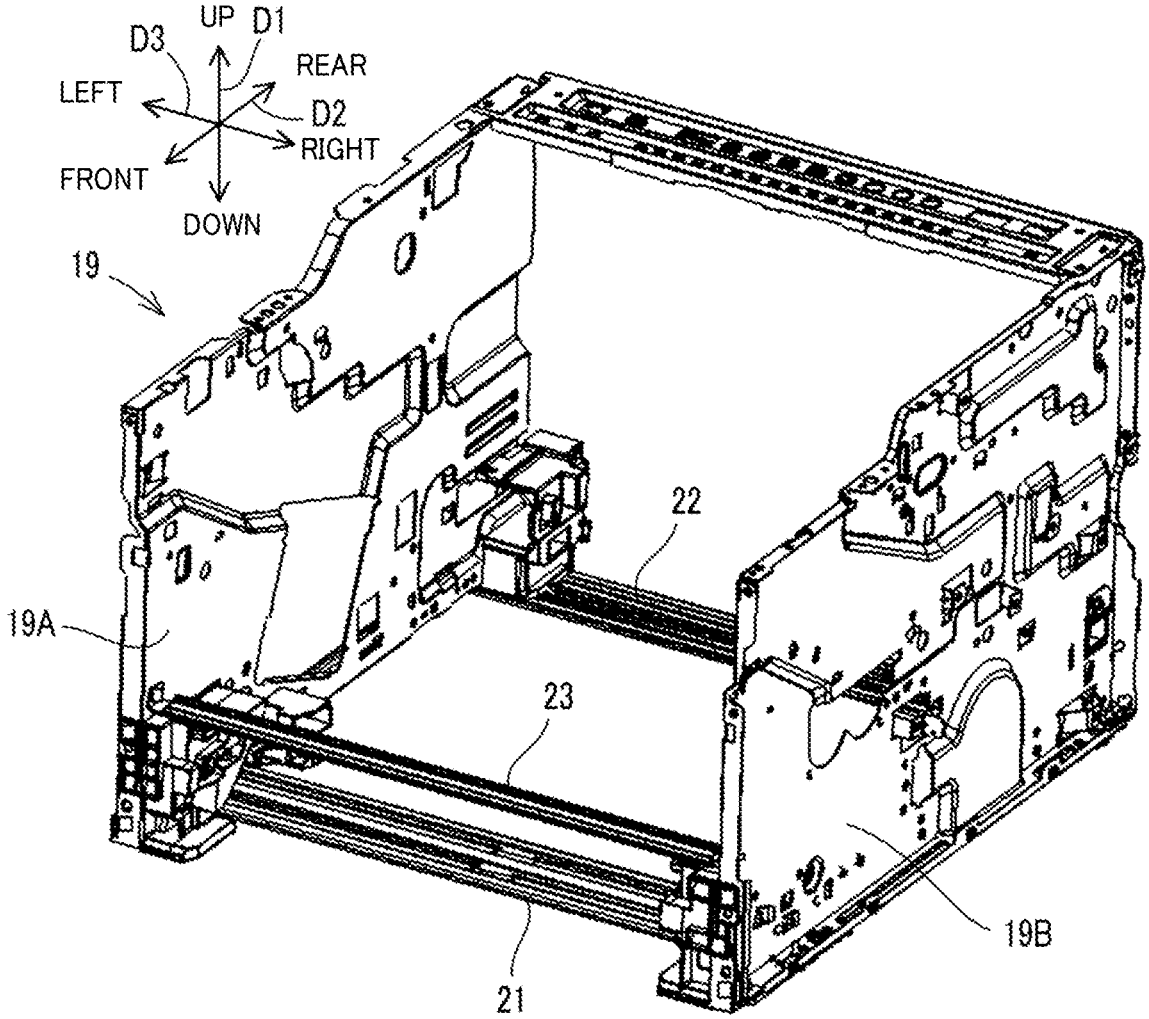
FIG. 2 is a perspective diagram of a housing of the image forming apparatus according to the embodiment of the present disclosure.
Figure 3:
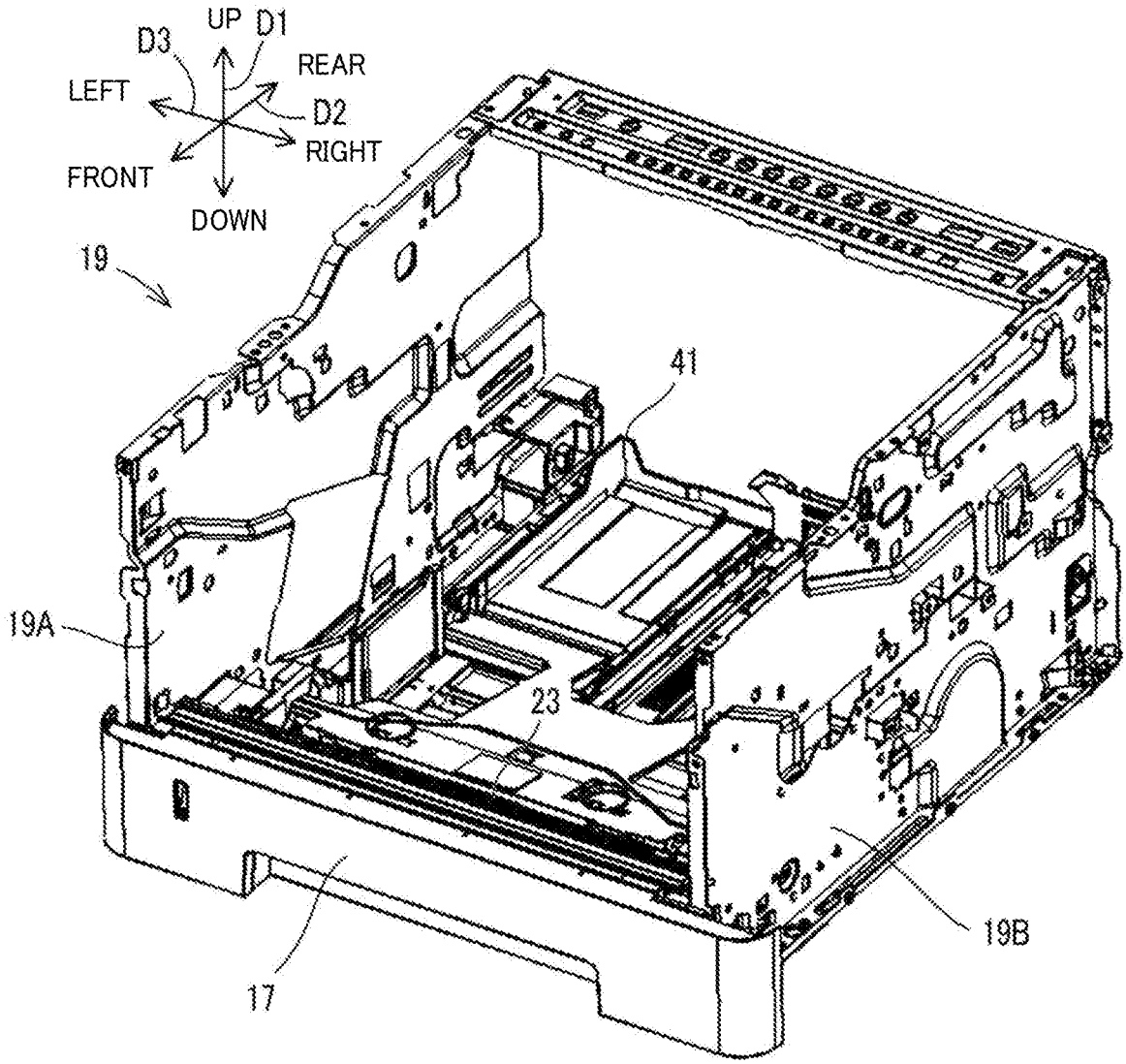
FIG. 3 is a perspective diagram of the housing of the image forming apparatus according to the embodiment of the present disclosure, showing a state where a paper cassette has been attached thereto.

FIG. 3 is a perspective diagram showing a state where the paper cassette 17 is attached to the housing 19 of the image forming portion 15. FIG. 2 is a perspective diagram of the housing 19. As shown in FIG. 1 and FIG. 2, the paper cassette 17 is provided at a lower portion of the housing 19. A plurality of print sheets (an example of the sheet of the present disclosure) of a predetermined size are stored in the paper cassette 17.

The housing 19 supports the paper cassette 17 such that the paper cassette 17 can be slid in and out the housing 19 in the front-rear direction D2 through a front surface of the image forming apparatus 10. As shown in FIG. 2 and FIG. 3, the housing 19 includes a pair of plate-like side frames 19A and 19B that are separated from each other in the left-right direction D3. The side frames 19A and 19B are formed from metal plates. As shown in FIG. 2, a front support frame 21 and a rear support frame 22 both extending in the left-right direction D3 are provided in a lower portion of the housing 19. The support frames 21 and 22 support, from below, the paper cassette 17 that has been inserted up to an attachment position set in the housing 19. The support frames 21 and 22 extend between the side frames 19A and 19B. The support frames 21 and 22 have the same height in the up-down direction D1.

A reinforcement frame 23 is provided on the front side of a lower portion of the housing 19. The reinforcement frame 23 is disposed more on the front side than the front support frame 21, and separated upward from the front support frame 21 by a certain interval. The paper cassette 17 can be inserted through an opening which is surrounded by the reinforcement frame 23, the front support frame 21, and the side frames 19A and 19B. It is noted that the certain interval is a size determined to allow for insertion of the paper cassette 17.

Figure 4:
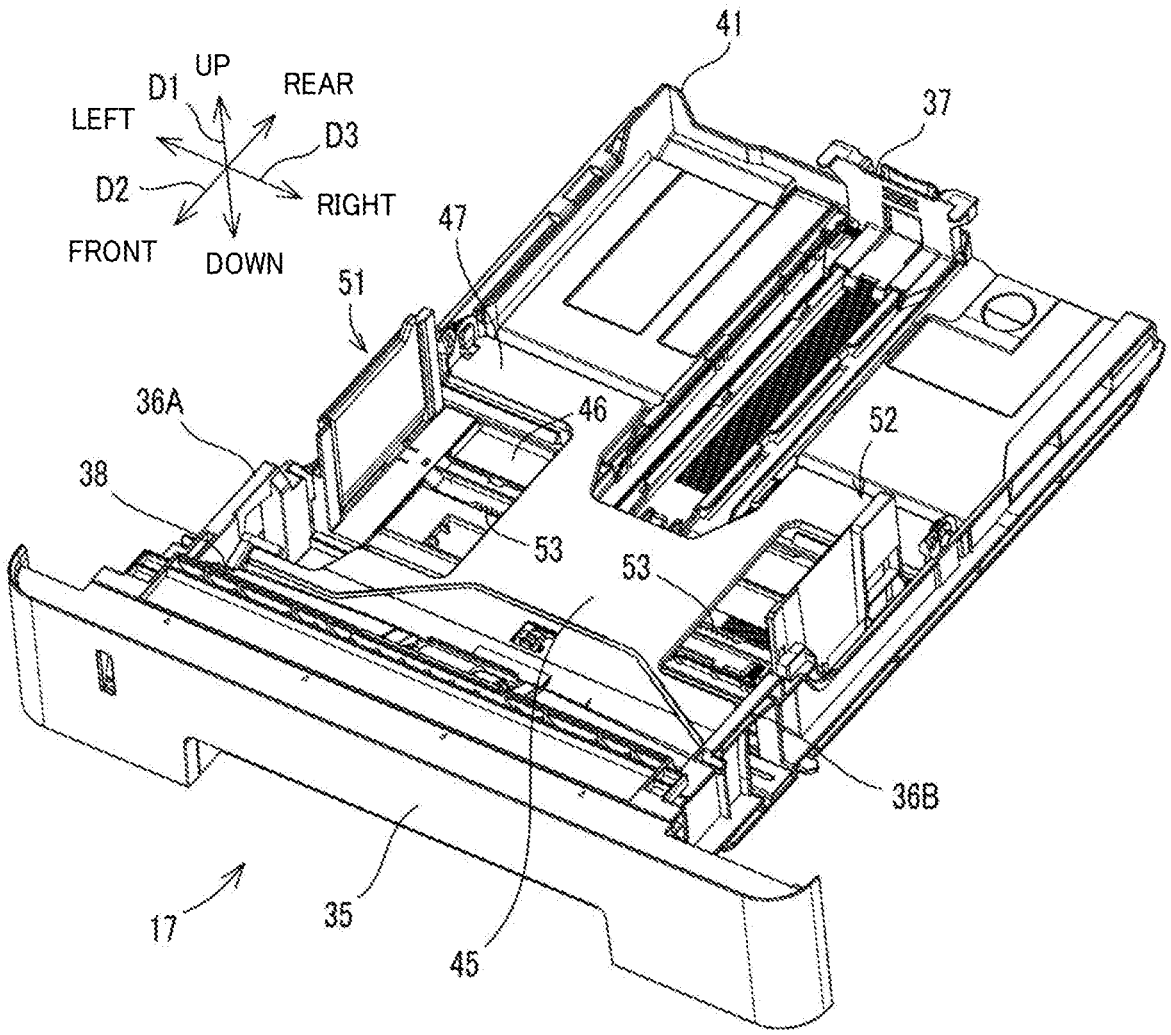
FIG. 4 is a perspective diagram showing a configuration of the paper cassette according to the embodiment of the present disclosure.

FIG. 4 is a perspective diagram of the paper cassette 17. The paper cassette 17 is supported by the housing 19 so as to be attached thereto in a detachable manner. As shown in FIG. 4, the paper cassette 17 includes a sheet storage portion 41 (an example of a sheet storage portion of the present disclosure) having a shape of a rectangular tray whose top is opened so that a plurality of print sheets can be stored therein. A plurality of print sheets are stacked in the sheet storage portion 41. A lift plate 45 is attached to a bottom plate 46 of the sheet storage portion 41, wherein the lift plate 45 is configured to be raised and lowered in the up-down direction D1. The lift plate 45 is provided on the front side of the bottom plate 46. The print sheets are stacked on the lift plate 45. A rear end portion 47 of the lift plate 45 is pivotably supported by the bottom plate 46 of the sheet storage portion 41, and a front end portion of the lift plate 45 is a free end. When the lift plate 45 is displaced in the up-down direction D1, the lift plate 45 is raised and lowered in the up-down direction D1 together with the print sheets.

The sheet storage portion 41 includes: a handle portion 35 on the front side thereof, a pair of side walls 36A and 36B on the left and right sides thereof; and a regulating member 37 for regulating the rear end of the sheets, on the rear side thereof. In addition, a guide member 38 is provided between the bottom plate 46 and the handle portion 35, wherein the guide member 38 has a guide surface that guides a front end of a print sheet diagonally upward when a sheet feed mechanism (not shown) feeds the print sheet frontward from the sheet storage portion 41.

The lift plate 45 is attached to an upper surface (bottom surface) of the bottom plate 46 of the sheet storage portion 41, with an elastic member (not shown) in between. The elastic member is, for example, a coil spring or a plate spring. The lift plate 45 is always biased upward by the elastic member. With this configuration, a top sheet of the print sheets stacked on the lift plate 45 is always in contact with a pickup roller of the sheet feed mechanism.

In addition, as shown in FIG. 4, the paper cassette 17 is provided with a pair of cursors 51 and 52 for positioning the plurality of print sheets (a sheet stack). The cursors 51 and 52 are provided on the bottom plate 46 of the sheet storage portion 41 in such a way as to move in the width direction of the paper cassette 17 (the left-right direction D3). In the present embodiment, the cursor 51 is provided on one side (left) in the width direction of the bottom plate 46 (hereinafter, the cursor 51 is referred to as a left cursor 51), and the cursor 52 is provided on the other side (right) in the width direction of the bottom plate 46 (hereinafter, the cursor 52 is referred to as a right cursor 52). Here, the right cursor 52 is an example of a sheet positioning member of the present disclosure. In addition, the moving direction (the width direction) of the right cursor 52 is an example of a first direction of the present disclosure. The cursors 51 and 52 abut on opposite sides of the print sheets stored in the paper cassette 17 in the width direction to regulate the print sheets to a predetermined position that corresponds to the size of the print sheets in the width direction, thereby positioning the print sheets stored in the paper cassette 17 to the predetermined position.

Figure 5:
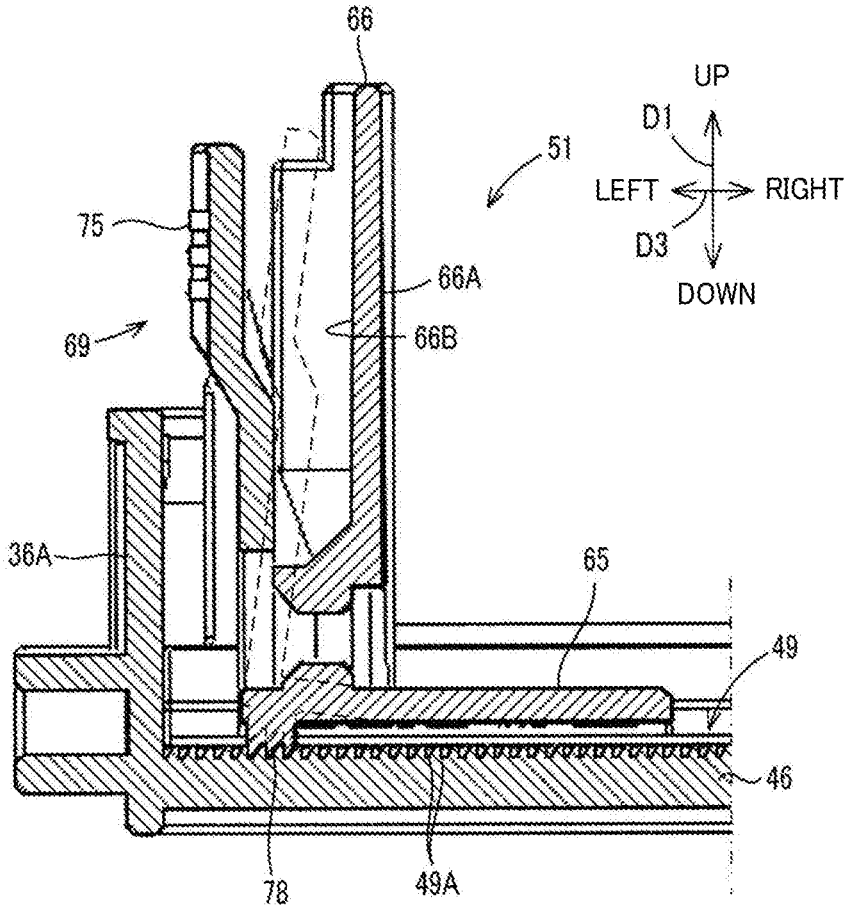
FIG. 5 is a cross section showing a configuration of a left cursor included in the paper cassette.

FIG. 5 is a cross section showing a configuration of the left cursor 51. As shown in FIG. 5, the left cursor 51 includes a flat-plate-like support plate 65 and a plate-like abutting portion 66, wherein the support plate 65 is slidably supported by the bottom plate 46, and the abutting portion 66 extends upward approximately vertically from the support plate 65. The left cursor 51 is made of, for example, a synthetic resin, and the support plate 65 and the abutting portion 66 are integrally formed with each other. The support plate 65 extends in the front-rear direction D2 along the upper surface (bottom surface) of the bottom plate 46. An inner side surface of the abutting portion 66 is referred to as an abutting surface 66A and abuts on the left side end portion of the sheet stack stored in the sheet storage portion 41. An upper surface of the support plate 65 supports an end portion (left side end portion) of the sheet stack in the width direction.

In the present embodiment, the left cursor 51 is provided on the bottom plate 46, in the vicinity of the left side wall 36A. The left cursor 51 abuts on the left side end of the sheet stack stored in the sheet storage portion 41 positions the sheet stack to the predetermined position. The left cursor 51 is supported by the bottom plate 46 in such a way as to slide in the width direction.

The pair of cursors 51 and 52 are configured to move in conjunction with each other in the width direction on the bottom plate 46. For example, a rack-pinion mechanism composed of rack gears 53 (see FIG. 4) and a pinion gear (not shown) is adopted as the mechanism for moving the cursors 51 and 52 in conjunction with each other. The rack gears 53 are respectively attached to the cursors 51 and 52, and the pinion gear is rotatably provided on the bottom plate 46. With this mechanism, the operator operates an operation lever 69 that is described below to unlock the left cursor 51 and slides only the left cursor 51 in the width direction. This allows the right cursor 52 to slide in the width direction in conjunction with the movement of the left cursor 51. It is noted that although FIG. 4 shows the rack gears 53 attached to the cursors 51 and 52, other components of the rack-pinion mechanism are not shown in the drawing.

As shown in FIG. 5, the left cursor 51 is provided with the operation lever 69. The operation lever 69 is provided separated leftward (outward in the width direction) from an outer side surface 66B of the abutting portion 66, the outer side surface 66B being opposed to the abutting surface 66A. The operation lever 69 is formed integrally with the support plate 65, extending upward from a left end portion of the support plate 65. The operation lever 69 is operated to slide the left cursor 51, and is a lever-like member elongated approximately in the up-down direction D1. The operation lever 69 is formed from an elastic synthetic resin or the like. An operation portion 75 that is held by the operator is provided in an upper end portion of the operation lever 69.

The operation lever 69 is configured to be displaced between a lock position and an unlock position, wherein the lock position is indicated by the solid line in FIG. 5, and the unlock position is indicated by the dotted line in FIG. 5. The operation lever 69 can be displaced between the lock position and the unlock position since it is formed from an elastic synthetic resin. In a state where the operation lever 69 is not operated, that is, in a state where no external force is applied to the operation lever 69, the operation lever 69 is always held at the lock position. On the other hand, in a state where the operation lever 69 is operated, that is, in a state where the operation lever 69 is bent toward the abutting portion 66, the operation lever 69 is located at the unlock position.

A lock claw 78 (an example of a lock piece) projecting downward is provided in a lower end portion of the operation lever 69. The lock claw 78 is formed in the shape of a claw that has a downward acute angle. The lock claw 78 is used to fix the left cursor 51 to an arbitrary position in the width direction on the bottom plate 46 of the sheet storage portion 41. The lock claw 78 is displaced in the up-down direction D1 when the operation lever 69 is displaced between the lock position and the unlock position.

An engaging portion 49 including a plurality of engaging grooves 49A formed at regular intervals in the width direction, is formed on the bottom plate 46 of the sheet storage portion 41. The engaging portion 49 is formed on the bottom plate 46 in a region in which the left cursor 51 moves. For example, the lock claw 78 is composed of gear teeth of a predetermined size, and the engaging portion 49 is a rack gear having gear teeth of the same size and the same pitch as those of the lock claw 78.

In the present embodiment, in a state where the operation lever 69 is not operated, the operation lever 69 is located at the lock position, and in this state, the lock claw 78 enters the engaging grooves 49A of the engaging portion 49 and is engaged therewith in the width direction (see FIG. 5). That is, in the state where the operation lever 69 is not operated, the lock claw 78 of the left cursor 51 keeps engaged with the engaging grooves 49A of the engaging portion 49. In that state, the left cursor 51 is locked to the bottom plate 46, and cannot move in the width direction.

When the operation portion 75 is operated by the operator, and the operation lever 69 is displaced from the lock position to the unlock position, the lock claw 78 is displaced upward and released from the engaging grooves 49A of the engaging portion 49 (see the dotted line in FIG. 5). This allows the left cursor 51 to be unlocked from the bottom plate 46 and movable in the width direction. That is, the unlock position is where the operation lever 69 is when the fixation of the left cursor 51 to the bottom plate 46 is removed.

Figure 6:
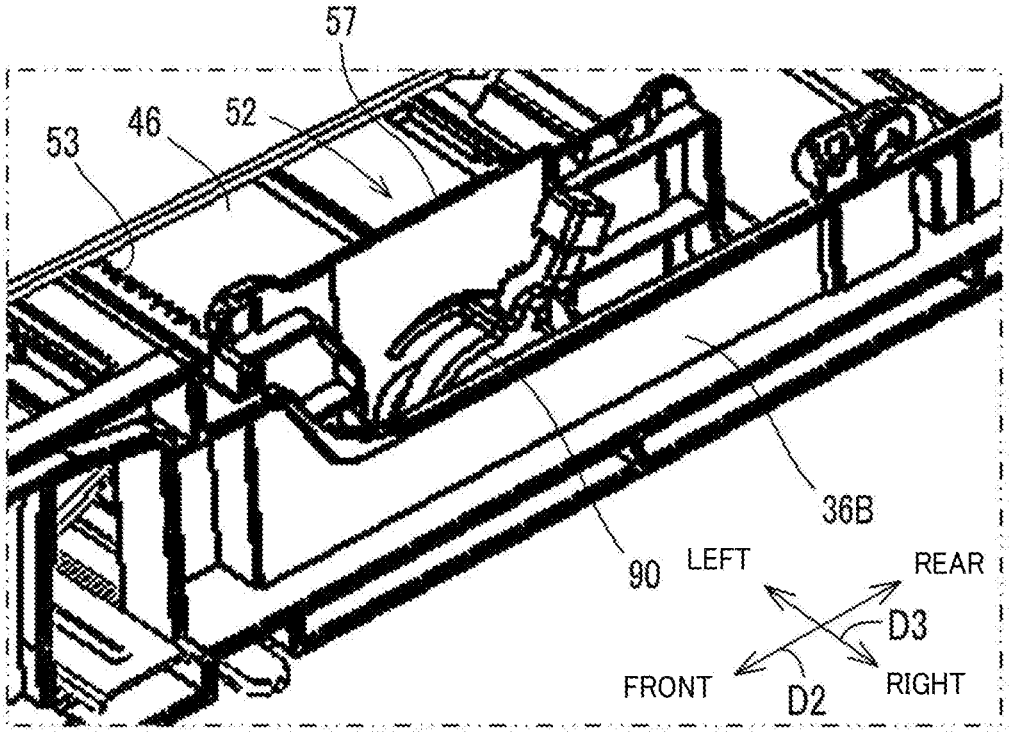
FIG. 6 is a perspective diagram showing a configuration of a right cursor included in the paper cassette.

FIG. 6 to FIG. 10 show a configuration of the right cursor 52. As shown in FIG. 6, the right cursor 52 is provided on the bottom plate 46, in the vicinity of the right side wall 36B. The right cursor 52 abuts on the right side end of the sheet stack stored in the sheet storage portion 41 and positions the sheet stack to the predetermined position. The right cursor 52 is supported by the bottom plate 46 in such a way as to slide in the width direction.

Figure 7:
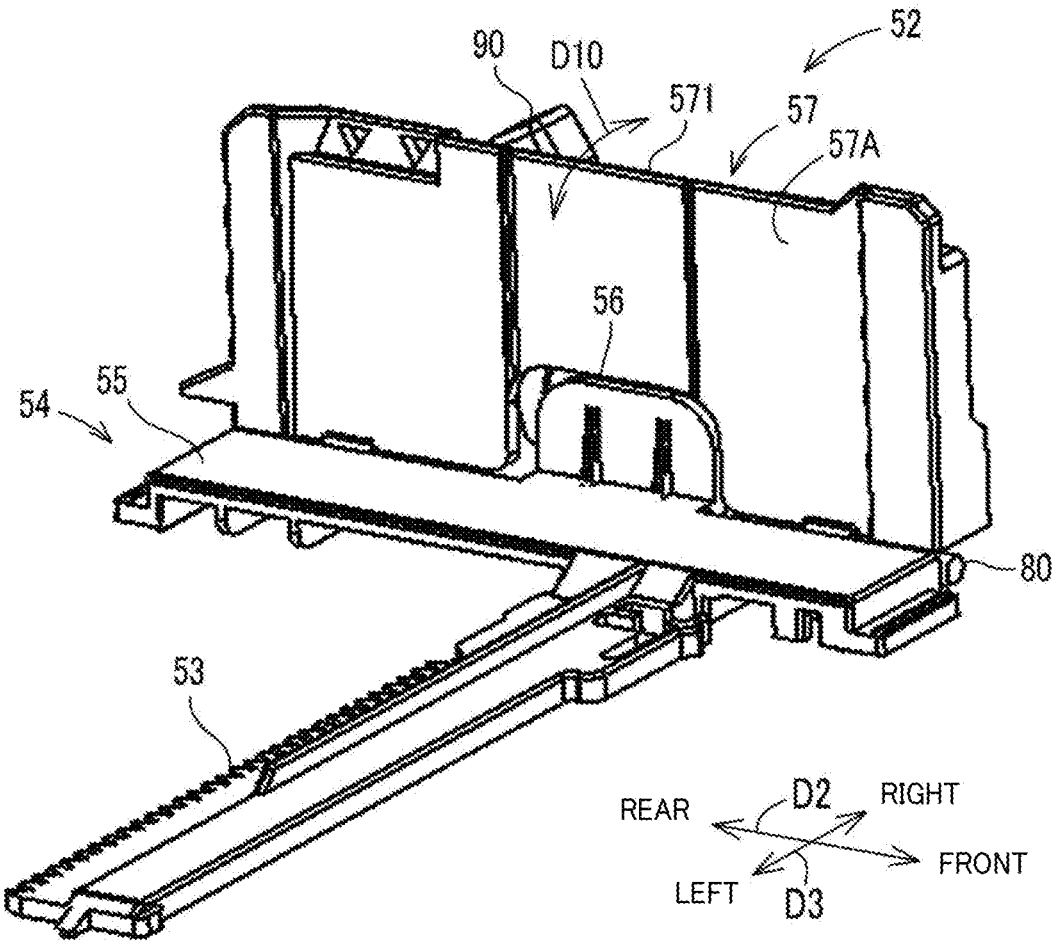
FIG. 7 is a perspective diagram showing a configuration of the right cursor, viewed from inside.

As shown in FIG. 7, the right cursor 52 includes a moving body 54 and an abutting portion 57, wherein the moving body 54 is configured to move on the upper surface of the bottom plate 46 in the left-right direction D3, and the abutting portion 57 is supported by the moving body 54. The moving body 54 is an example of a moving body of the present disclosure, and the abutting portion 57 is an example of an abutting portion of the present disclosure.

The moving body 54 includes a plate-like support plate 55 (an example of a support portion) and a plate-like vertical plate 56 (an example of a side plate portion), wherein the support plate 55 is slidably supported by the bottom plate 46, and the vertical plate 56 extends upward approximately in the vertical direction from the support plate 55. The moving body 54 is made of, for example, a synthetic resin, and the support plate 55 and the vertical plate 56 are integrally formed with each other. The support plate 55 extends in the front-rear direction D2 along the upper surface (bottom surface) of the bottom plate 46. An end portion (right end portion) of the sheet stack in the width direction is supported by an upper surface of the support plate 55. The vertical plate 56 is provided on a side of a back surface (right surface) of the abutting portion 57, and projects upward from a right end portion of the support plate 55 (see FIG. 10, FIG. 11).

The abutting portion 57 is supported by the moving body 54. The abutting portion 57 includes a main body portion 571 that is formed in an approximately rectangular shape. An inner side surface of the main body portion 571 is referred to as an abutting surface 57A and abuts on the right side end portion of the sheet stack to position the sheet stack. The abutting portion 57 is a plate-like member extending in the up-down direction D1, and is supported by the moving body 54 such that the main body portion 571 faces an inner side surface 56B of the vertical plate 56.

Figure 8:
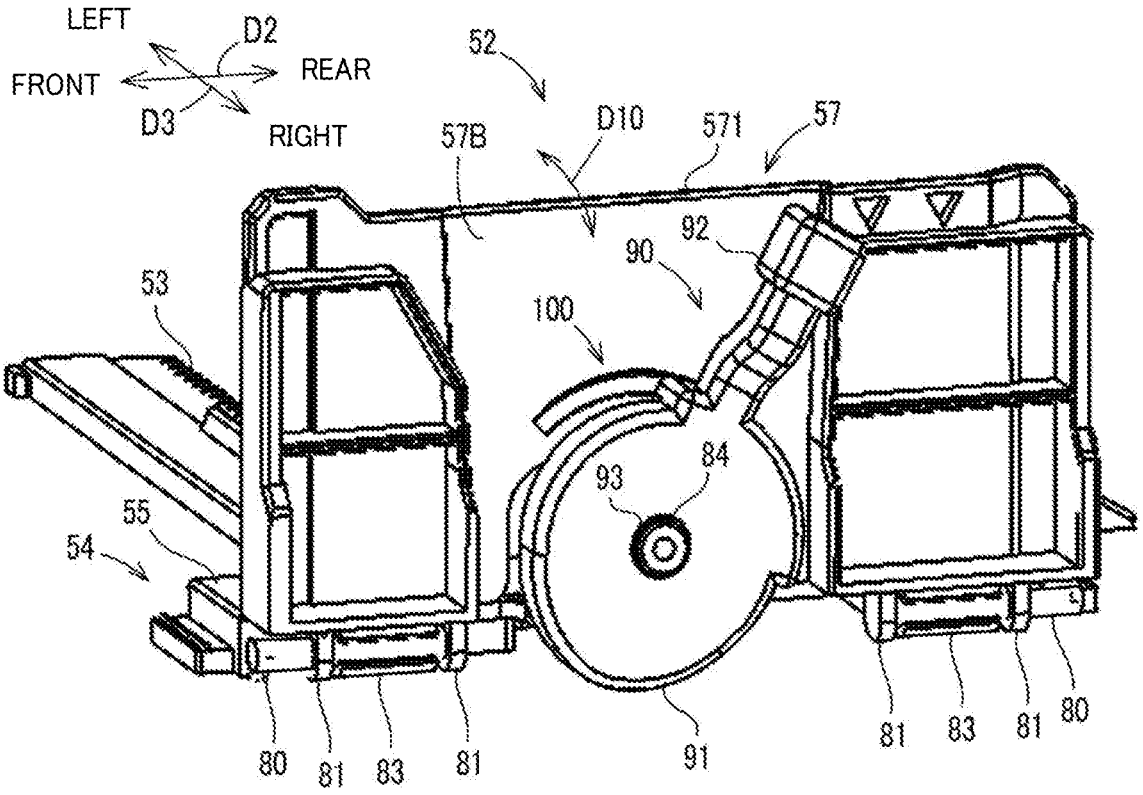
FIG. 8 is a perspective diagram of the right cursor viewed from outside, showing a state where a lever is located at a pressing position.

The abutting portion 57 is supported in such a way as to be displaced in the left-right direction D3 with respect to the vertical plate 56. Specifically, as shown in FIG. 8, a pivot shaft 80 is provided at each of opposite ends of a lower end portion of the main body portion 571 in the front-rear direction D2. Each of the pivot shafts 80 extends frontward or rearward. The pivot shafts 80 are pivotably supported by bearings 81 that are provided on the support plate 55. This allows the abutting portion 57 to be displaced with respect to the vertical plate 56 in a direction indicated by the arrow D10 in FIG. 8.

The right cursor 52 is provided with torsion coil springs 83 (elastic member) that bias the abutting portion 57 outward (rightward) in the width direction. The torsion coil springs 83 are an example of a biasing member of the present disclosure. In a state where the pivot shafts 80 are inserted through the torsion coil springs 83, one end of each of the torsion coil springs 83 is fixed to the pivot shaft 80 or the abutting portion 57, and the other end is fixed to the bearing 81. In the present embodiment, the torsion coil springs 83 are provided as one example of the biasing member. However, not limited to the torsion coil springs 83, other types of elastic member may be applied as far as they can bias the abutting portion 57 outward (rightward) in the width direction.

The abutting portion 57 is biased outward (rightward) with respect to the vertical plate 56 by the torsion coil springs 83. As a result, in a state where no other external force is applied to the abutting portion 57, for example, in a state where the abutting portion 57 is not pressed by a circular arc cam 100 described below, the abutting portion 57 is separated rightward from the right side end portion of the sheet stack by the elastic force of the torsion coil springs 83, is in contact with a lever 90 described below at a non-regulating position (the position shown in FIG. 13) so as not to regulate the right side end portion of the sheet stack, and stands still there. It is noted that when the lever 90 described below is operated and the circular arc cam 100 is pressed toward the right side end portion of the sheet stack, the abutting portion 57 is displaced to a regulating position where it abuts on and regulates the right side end portion of the sheet stack.

Figure 9:
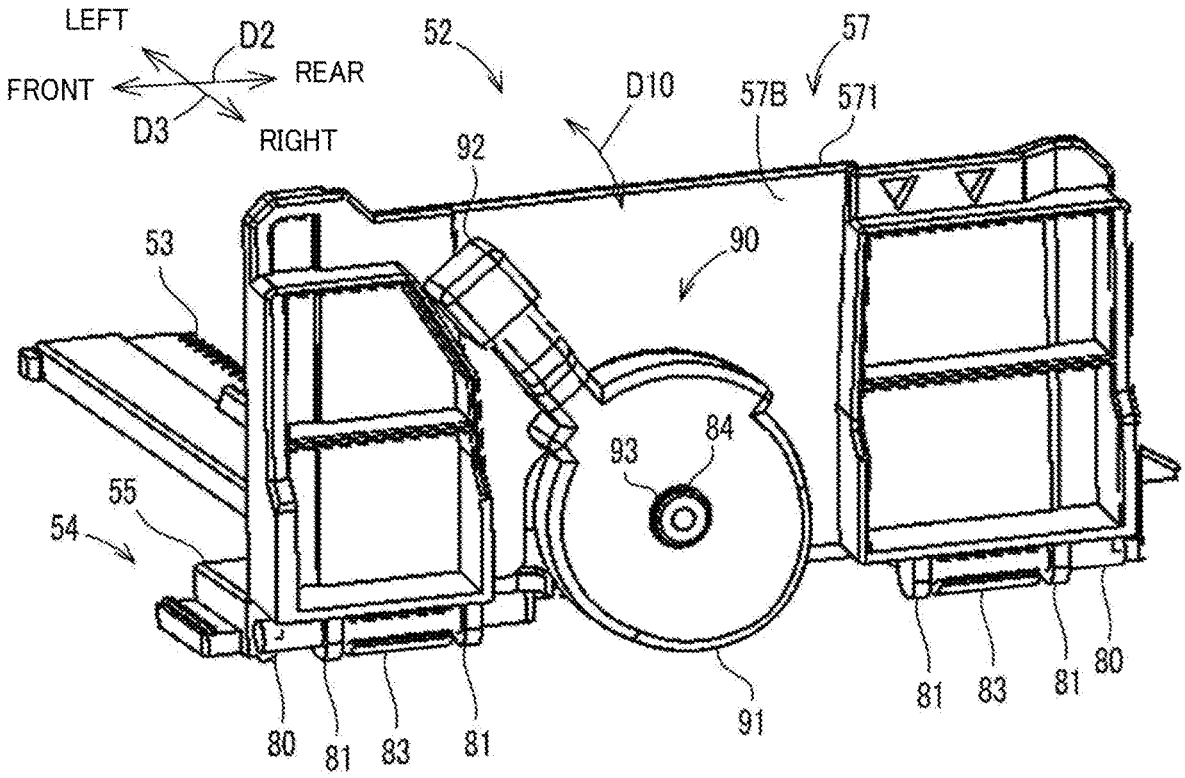
FIG. 9 is a perspective diagram of the right cursor viewed from outside, showing a state where the lever is located at a non-pressing position.
Figure 10:
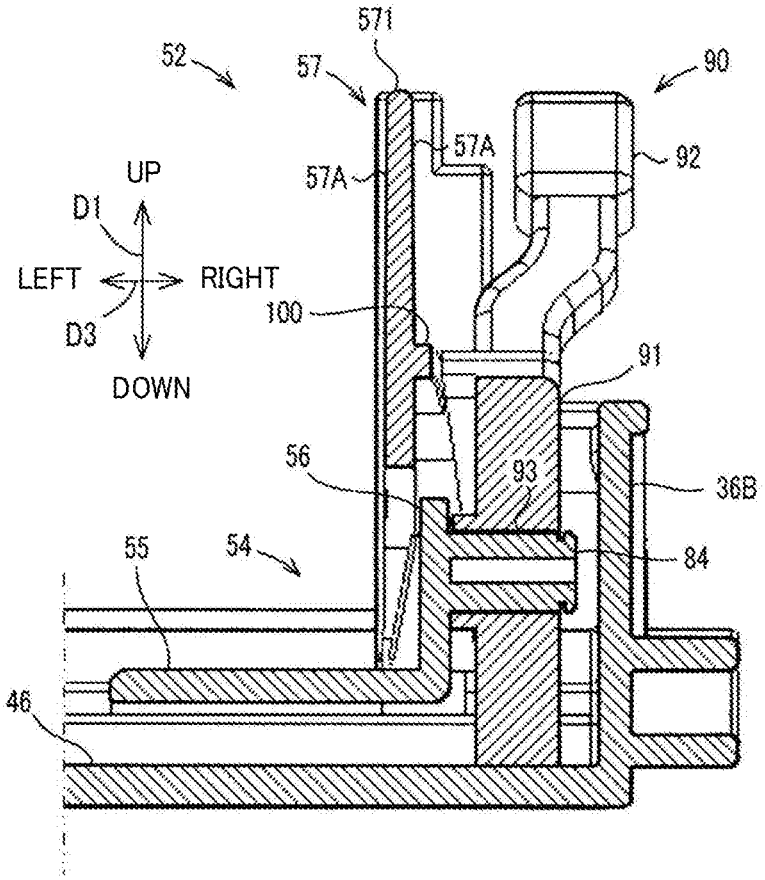
FIG. 10 is a cross section showing a configuration of the right cursor.

As shown in FIG. 8 to FIG. 10, the right cursor 52 includes the lever 90 (an example of an operation member of the present disclosure). The lever 90 is operated by the user. The lever 90 is disposed more on the outer side (right) than the main body portion 571 of the abutting portion 57. It is noted that the lever 90 is omitted in FIG. 4. The lever 90 is pivotably supported by the moving body 54. Specifically, as shown in FIG. 10, a support shaft 84 is formed to project outward from an outer side surface 56A of the vertical plate 56 and extend in the moving direction of the right cursor 52, and the lever 90 is rotatably supported by the support shaft 84. The lever 90 includes a disk-shaped rotor 91 and an arm portion 92, wherein the rotor 91 includes a shaft hole 93 (see FIG. 12) so as to be supported by the support shaft 84, and the arm portion 92 projects from an outer peripheral portion of the rotor 91. With the operation of the arm portion 92, the lever 90 pivots between a pressing position (the position shown in FIG. 8) and a non-pressing position (the position shown in FIG. 9).

Figure 11:
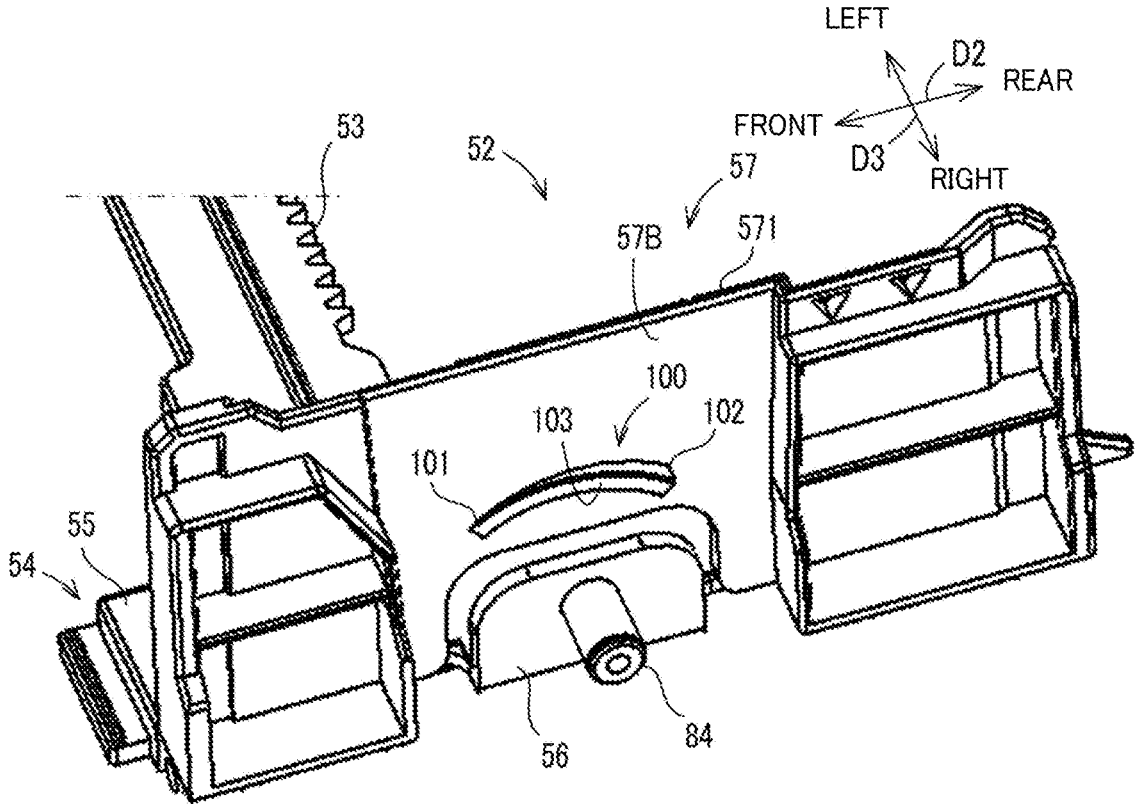
FIG. 11 is a perspective diagram showing a state where the lever has been removed from the right cursor.

FIG. 11 shows the right cursor 52 in a state where the lever 90 is removed. As shown in FIG. 11, the circular arc cam 100 (an example of a cam portion of the present disclosure) is provided on an outer side surface 57B of the abutting portion 57. The circular arc cam 100 is configured to be pressed by the lever 90 in response to a pivoting operation of the lever 90, and the pressed circular arc cam 100 displaces the abutting portion 57 toward the sheet stack.

The circular arc cam 100 is formed on the outer side surface 57B, above the support shaft 84. The circular arc cam 100 extends in the front-rear direction D2, and is formed in a circular arc shape centering on the support shaft 84. The circular arc cam 100 is a circular-arc rib that projects from the outer side surface 57B outward. The circular arc cam 100 is what is called an inclined cam formed on the outer side surface 57B, and has a cam surface 103 (see FIG. 11) that is gradually inclined from a front end portion 101 to a rear end portion 102. In the present embodiment, the front end portion 101 has the smallest projection amount, and the rear end portion 102 has the largest projection amount.

Figure 12:
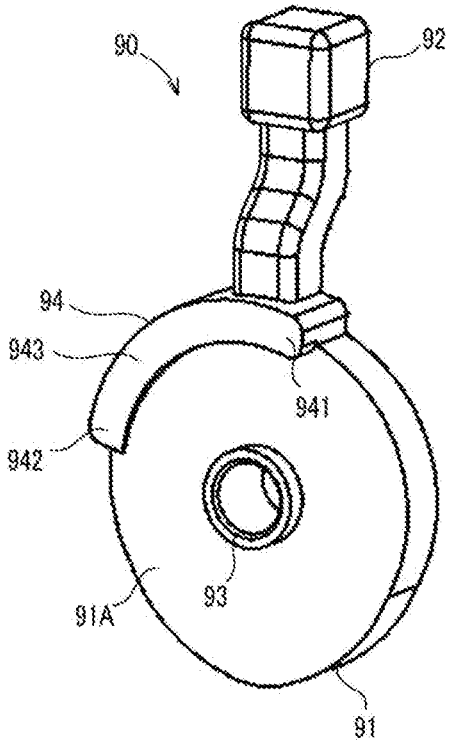
FIG. 12 is a perspective diagram showing the lever.

FIG. 12 is a perspective diagram of the lever 90. As shown in FIG. 12, the rotor 91 of the lever 90 includes an inclined portion 94 that has an inclined surface that abuts on the circular arc cam 100 depending on a pivot position of the lever 90. The inclined portion 94 is provided on an inner side surface 91A that faces the outer side surface 57B. The inclined portion 94 is formed in the shape of a circular arc in correspondence with the shape of the circular arc cam 100, and projects from the inner side surface 91A in the axial direction of the support shaft 84. In the present embodiment, among portions of the inclined portion 94, a front end portion 941 has the largest projection amount, and a rear end portion 942 has the smallest projection amount, the inclined portion 94 being inclined toward the rear end portion 942. That is, the inclined portion 94 is what is called an inclined cam and has an inclined surface 943 that is gradually inclined from the front end portion 941 to the rear end portion 942. The inclined surface 943 has the same inclination angle as the cam surface 103 of the circular arc cam 100, and when the lever 90 is located at the non-pressing position (see FIG. 9), the inclined surface 943 and the cam surface 103 are face-contacted with each other.

Meanwhile, in a conventional technology, a spring member is used to bias a side surface of sheets. With such a configuration, however, there may be a case where the spring member becomes an obstacle and the user cannot store sheets in a paper cassette in a state where a positioning member is disposed at a position corresponding to a size of the sheets. In that case, the user needs to displace the positioning member outside in advance, store the sheets in the paper cassette, and then move the positioning member to a predetermined position corresponding to the size of the sheets. As understood from this, the paper setting method of the conventional technology is complicated, and the operability is not good in storing sheets in the paper cassette.

Figure 13:
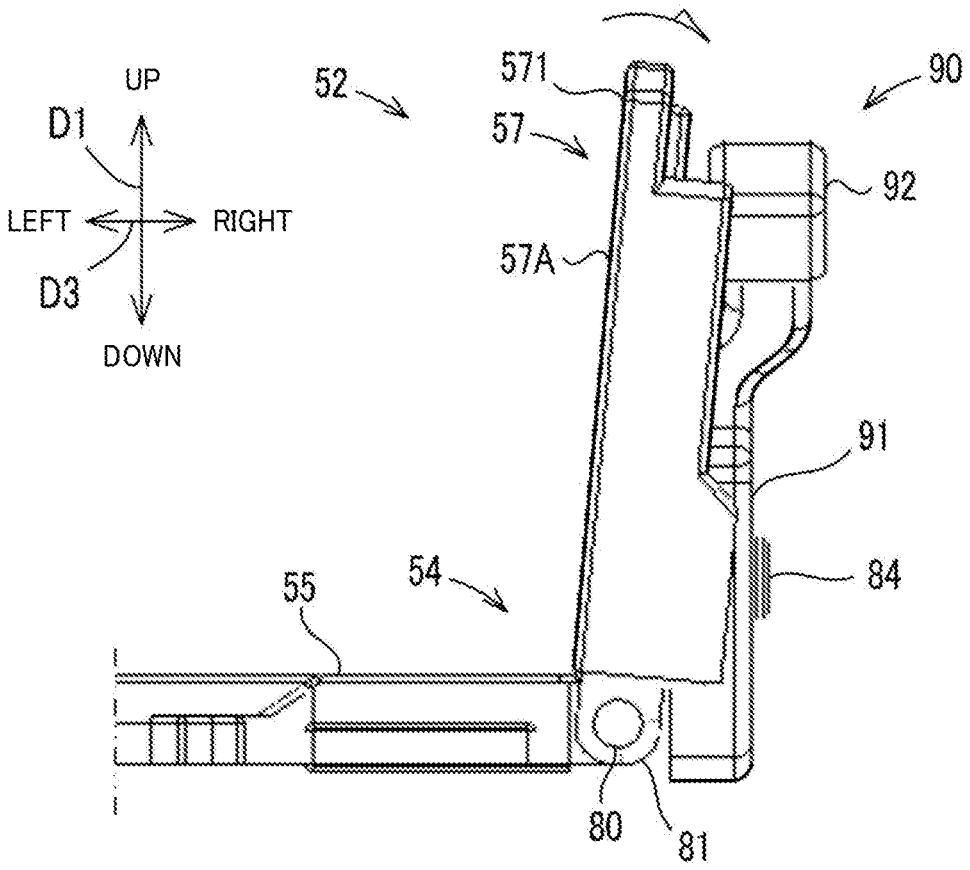
FIG. 13 is a diagram showing a state where an abutting portion is located at a non-regulating position in response to an operation of the right cursor.

In the present embodiment, as shown in FIG. 13, when the lever 90 is pivoted to the frontmost position and displaced to the non-pressing position, the front end portion 941 of the inclined portion 94 and the front end portion 101 of the circular arc cam 100 face each other. In this state, the circular arc cam 100 is released from being pressed inward by the inclined portion 94 of the lever 90, and the abutting portion 57 is biased toward the outside by the biasing force of the torsion coil springs 83, and the abutting portion 57 is separated from the sheet stack. At this time, the abutting portion 57 is located at the non-regulating position as shown in FIG. 13. Accordingly, the user can widen the space between the cursors 51 and 52 at the predetermined position by displacing the lever 90 to the non-regulating position when the paper cassette 17 is empty. With this configuration, the user neither needs to move the cursors 51 and 52 to widen the space therebetween before storing print sheets in the paper cassette 17, nor needs to return the cursors 51 and 52 to the predetermined position thereafter. As a result, the user can store the print sheets in the paper cassette 17 easily while keeping the cursors 51 and 52 at the predetermined position. That is, the print sheets can be easily set to the paper cassette 17, and the paper cassette 17 is inserted with excellent operability.

Figure 14:
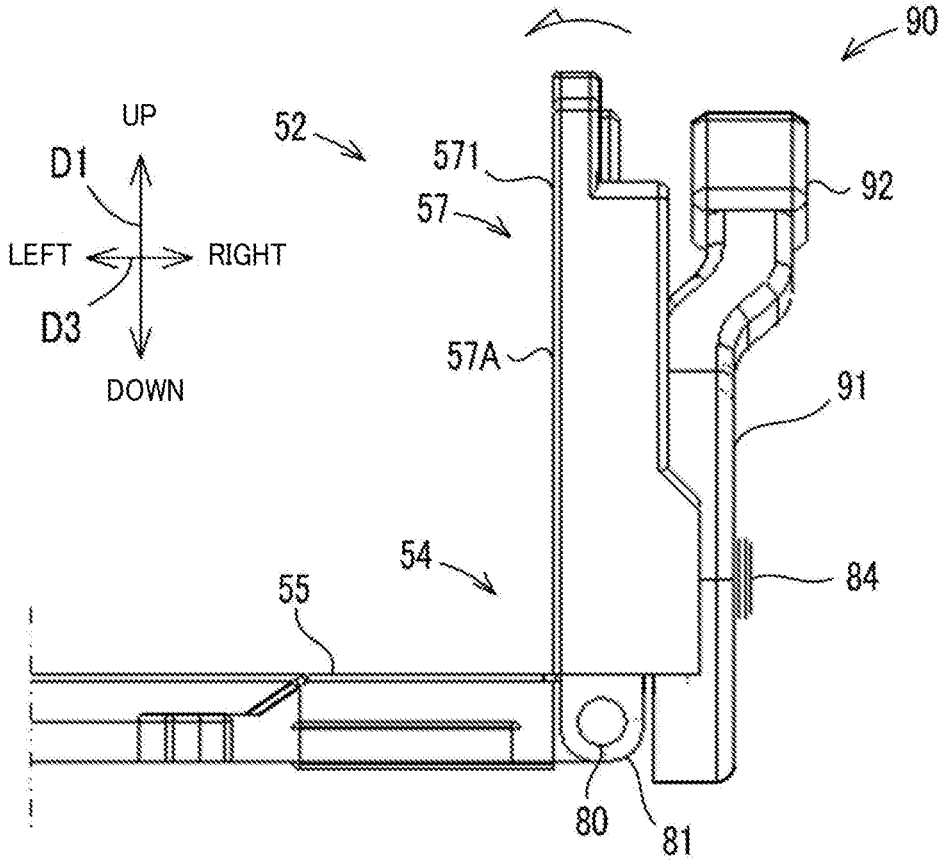
FIG. 14 is a diagram showing a state where the abutting portion is located at a regulating position in response to an operation of the right cursor.

In addition, as shown in FIG. 14, when the lever 90 is pivoted to the rearmost position and displaced to the pressing position, the front end portion 941 of the inclined portion 94 and the rear end portion 102 of the circular arc cam 100 face each other. At this time, the circular arc cam 100 is pressed inward by the inclined portion 94 of the lever 90 against the biasing force of the torsion coil springs 83, and the abutting portion 57 is displaced toward the sheet stack. At this time, the abutting surface 57A of the abutting portion 57 abuts on the right side end portion of the sheet stack, and regulates the sheet stack to the predetermined position. At this time, the abutting portion 57 is located at the regulating position as shown in FIG. 14. Accordingly, after storing print sheets in the paper cassette 17, the user can regulate the end portions of the print sheets in the width direction by operating and displacing the lever 90 from the non-pressing position to the pressing position to displace the cursors 51 and 52 to the regulating position.

In the above-described embodiment, the right cursor 52 includes the circular arc cam 100 and the lever 90. However, not limited to this configuration, for example, the circular arc cam 100 and the lever 90 may be provided in each of the left cursor 51 and the right cursor 52.

In the above-described embodiment, the circular arc cam 100 is provided on the outer side surface 57B, and the rotor 91 of the lever 90 includes the inclined portion 94. However, the present disclosure is not limited to this configuration. For example, the outer side surface 57B may include the circular arc cam 100, and the lever 90 may include a projection portion (projection), such as a boss, that abuts on the circular arc cam 100. Alternatively, the lever 90 may include the inclined portion 94, and the outer side surface 57B may include a projection portion (projection), such as a boss, that abuts on the inclined portion 94. In this case, the inclined portion 94 has a role of a cam portion of the present disclosure.

The shape of the circular arc cam 100 and the inclined portion 94 is not limited to the circular arc. In the above-described embodiment, a cam portion having a circular arc shape is described as one example. However, the cam portion may have any shape as far as it can displace the abutting portion 57 toward the sheet stack when it is pressed by the lever 90 in response to a pivoting of the lever 90.

In the above-described embodiment, the present disclosure is applied to the right cursor 52 of the paper cassette 17. However, the present disclosure is not limited to the configuration. For example, the cursor 14A of the image reading device 11 may be configured similar to the right cursor 52.

In the above-described embodiment, the abutting portion 57 pivots around the pivot shafts 80. However, the present disclosure is not limited to the configuration. For example, the abutting portion 57 may move approximately horizontally in the left-right direction D3 between the non-regulating position and the regulating position.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet positioning member that is provided on a sheet placing surface in such a way as to be movable in a predetermined first direction, and positions a sheet placed on the sheet placing surface by abutting on a side end portion of the sheet at a side in the first direction, the sheet positioning member comprising:

a moving body configured to move in the first direction on the sheet placing surface;

an abutting portion supported by the moving body and having an abutting surface that abuts on the side end portion of the sheet when the sheet positioning member positions the sheet;

an operation member supported by the moving body so as to be pivotable around a support shaft that extends in the first direction, on a side of a back surface of the abutting portion, the back surface being opposite to the abutting surface;

a cam portion configured to displace the abutting portion toward the side end portion of the sheet by being pressed by the operation member in response to a pivoting operation of the operation member; and a biasing member configured to bias the abutting portion with respect to the moving body in a direction opposite to the side end portion of the sheet, wherein the cam portion displaces the abutting portion toward the side end portion of the sheet against a biasing force of the biasing member, a lower end portion of the abutting portion is pivotably supported by the moving body via a pivot shaft that extends perpendicular to the first direction, and the biasing member is an elastic member attached to the pivot shaft, and has an elastic force that causes the abutting portion to pivot in a direction of separating from the side end portion of the sheet.

2. A sheet storage device comprising:

the sheet positioning member according to claim 1; and a sheet storage portion that includes the sheet placing surface, the sheet storage portion configured to store the sheet stacked on the sheet placing surface.

3. An image processing apparatus comprising:

the sheet storage device according to claim 2; and an image processing portion configured to perform image processing on the sheet fed from the sheet storage device.

4. A sheet positioning member that is provided on a sheet placing surface in such a way as to be movable in a predetermined first direction, and positions a sheet placed on the sheet placing surface by abutting on a side end portion of the sheet at a side in the first direction, the sheet positioning member comprising:

a moving body configured to move in the first direction on the sheet placing surface;

an abutting portion supported by the moving body and having an abutting surface that abuts on the side end portion of the sheet when the sheet positioning member positions the sheet;

an operation member supported by the moving body so as to be pivotable around a support shaft that extends in the first direction, on a side of a back surface of the abutting portion, the back surface being opposite to the abutting surface; and a cam portion configured to displace the abutting portion toward the side end portion of the sheet by being pressed by the operation member in response to a pivoting operation of the operation member, wherein the cam portion is provided above the support shaft on the back surface of the abutting portion and formed in a circular arc shape centering on the support shaft.

5. The sheet positioning member according to claim 4, wherein the cam portion is an inclined cam formed on the back surface of the abutting portion so as to incline from one end to the other.

6. The sheet positioning member according to claim 5, wherein the moving body includes:

a support plate extending along the sheet placing surface in a direction perpendicular to the first direction in such a way as to support the side end portion of the sheet; a vertical plate provided on the side of the back surface of the abutting portion to extend upward from the support plate; and the support shaft that projects from the vertical plate, and the operation member includes:

a disk-shaped rotor pivotally supported by the support shaft; an arm portion projecting from an outer peripheral portion of the rotor; and an inclined portion provided on the outer peripheral portion of the rotor in such a way as to abut on the inclined cam.

7. A sheet storage device comprising:

the sheet positioning member according to claim 4; and a sheet storage portion that includes the sheet placing surface, the sheet storage portion configured to store the sheet stacked on the sheet placing surface.

8. An image processing apparatus comprising:

the sheet storage device according to claim 7; and an image processing portion configured to perform image processing on the sheet fed from the sheet storage device.

* * * * *